United States Patent [19]

Indeherbergh et al.

[11] Patent Number: 4,482,441

[45] Date of Patent: Nov. 13, 1984

[54] PERMEABLE DIAPHRAGM, MADE FROM A HYDROPHOBIC ORGANIC POLYMERIC MATERIAL, FOR A CELL FOR THE ELECTROLYSIS OF AQUEOUS SOLUTIONS OF AN ALKALI METAL HALIDE

[75] Inventors: Jean Indeherbergh, Rueil-Malmaison, France; Edgard Nicolas, Meise-Eversem, Belgium

[73] Assignee: Solvay & Cie, Brussels, Belgium

[21] Appl. No.: 533,641

[22] Filed: Sep. 16, 1983

Related U.S. Application Data

[63] Continuation of Ser. No. 248,221, Mar. 27, 1981, abandoned.

[30] Foreign Application Priority Data

Mar. 27, 1980 [FR] France ..... 80 06919

[51] Int. Cl.[3] ..... C25B 1/00

[52] U.S. Cl. ..... 204/128; 204/129; 204/296

[58] Field of Search ..... 204/295, 296, 128, 129

[56] References Cited

U.S. PATENT DOCUMENTS

| | | | |
|---|---|---|---|
| 1,865,152 | 6/1932 | Stuart | 204/295 X |
| 4,125,451 | 11/1978 | Patil et al. | 204/296 |
| 4,126,536 | 11/1978 | Balko et al. | 204/296 |
| 4,238,303 | 12/1980 | Fang | 204/98 |
| 4,253,935 | 3/1981 | Simmons | 204/295 |
| 4,330,602 | 5/1982 | O'Rell et al. | 429/206 |

*Primary Examiner*—John F. Niebling

*Attorney, Agent, or Firm*—Robert E. Burns; Emmanuel J. Lobato; Bruce L. Adams

[57] ABSTRACT

Permeable diaphragm for a cell for the electrolysis of aqueous solutions of an alkali metal halide, the diaphragm being made from a hydrophobic organic polymeric material containing an oxide of a metal chosen from amongst group IIa of the periodic table of the elements, the oxide being in the form of particles having a mean diameter of at most 0.5 $\mu$m.

7 Claims, No Drawings

PERMEABLE DIAPHRAGM, MADE FROM A HYDROPHOBIC ORGANIC POLYMERIC MATERIAL, FOR A CELL FOR THE ELECTROLYSIS OF AQUEOUS SOLUTIONS OF AN ALKALI METAL HALIDE

This is a continuation, Ser. No. 248,221, filed Mar. 27, 1981 abandoned.

The present invention relates to a process of manufacturing chlorine and hydrogen in an electrolytic cell containing an aqueous solution of alkali metal chloride and having an anode and a cathode with a permeable diaphragm positioned between the anode and cathode. In the operation of such cells the nature of the diaphragm has been found to be highly important.

It is known to use diaphragms based on organic polymers in electrolysis cells.

The strongly hydrophobic character of the organic polymers which are suitable for this application makes it necessary to incorporate hydrophilic additives in such diaphragms; these additives are usually inorganic compounds in particle form, such as asbestos fibres, mica, talc or particles of titanium dioxide, alumina, silica or potassium titanate.

Thus, U.S. Pat. No. 3,702,267 published on Nov. 7, 1972 and assigned to E. I. Du Pont de Nemours describes a permeable diaphragm for an electrolysis cell, which diaphragm is obtained by coagulating a dispersion of polytetrafluoroethylene and of a hydrophilic inorganic additive in particle form (alumina, silica or titanium dioxide), calendering the resulting coagulum to bring it into the form of a sheet and drying the sheet.

U.S. Pat. No. 3,627,859, published on Dec. 14, 1971 and assigned to Leesona Corp. describes a diaphragm, possessing controlled permeability, for an electrolysis cell, this diaphragm being obtained by coagulating a colloidal suspension of a hydrophilic inorganic compound (potassium titanate, titanium dioxide, thorium dioxide or zirconium oxide) onto cellulosic fibres, coagulating a colloidal suspension of a fluorinated polymer onto the cellulosic fibres coated with the hydrophilic inorganic compound, forming a sheet with the resulting coagulum, drying the sheet and heating it in order to melt the polymer and burn the cellulosic fibres. In this way, a coherent porous sheet, of which the pores are lined with the hydrophilic inorganic compound, is obtained.

U.S. Pat. No. 4,036,729 to Patil et al., published on July 19, 1977, relates to a permeable diaphragm which consists of a felt formed on the perforated cathode of an electrolysis cell, from a dispersion of a fibrous polymeric material and a hydrophilic inorganic compound (asbestos, mica, talc, barium titanate, potassium titanate, titanium dioxide or boron nitride) in an aqueous medium containing acetone and a surface-active agent.

By virtue of a suitable choice of the polymers present in their structure, these known diaphragms generally exhibit the advantage of being inert towards corrosive chemical media present in the electrochemical cells, such as acidic brines of sodium chloride, or aqueous sodium hydroxide solutions.

Nevertheless, they exhibit the serious disadvantage of generally requiring excessively high contents of hydrophilic inorganic compounds, which contents can sometimes exceed 90% of the total weight of the diaphragm, thereby greatly complicating the use of the diaphragms and, furthermore, having an adverse effect on their cohesion and their mechanical strength.

It has also been proposed, in Belgian Pat. No. 870,771, filed on Mar. 26, 1979 in the name of Olin Corporation, to manufacture a diaphragm for an electrolysis cell by impregnating a support fabric, made from a polymeric material, with a substance containing a siliceous compound. In addition to the siliceous compound, the impregnating substance can optionally also contain an additive intended to improve the ionic conductivity of the diaphragm, such as magnesium oxide or alumina. The siliceous compound in the impregnating substance must furthermore be in the form of particles whose diameter must be greater than 1 μm and is preferably set at between 1 and 75 μm.

This known diaphragm suffers from the disadvantage of having a delicate and expensive construction; its intrinsic properties, especially its premeability to aqueous electrolytes, are difficult to reproduce, because they greatly depend on the nature and origin of the siliceous compound.

European Patent Application No. 79/102,380.7, filed on July 11, 1979 in the name of E. I. du Pont de Nemours and Co., and published on Mar. 19, 1980 under No. 8,635, proposes to overcome the abovementioned disadvantages by producing the diaphragms from a fluorinated polymeric material containing carboxylic hydrophilic functional groups and incorporating into the material a magnesium compound chosen from amongst magnesium oxide, magnesium hydroxide, magnesium carbonate, the magnesium oxyhalides and the magnesium hydroxyhalides, the magnesium compound being chemically bonded to the fluorinated polymeric material. In these known diaphragms, the carboxylic functional groups of the fluorinated polymer have the function of imparting the desired hydrophilic character to the diaphragms, whilst the magnesium compound, chemically bonded to the polymer, has the function of improving the stability, and the constancy of properties, of the diaphragms.

Such diaphragms have the disadvantage of being difficult and expensive to manufacture.

Belgian Pat. No. 833,912, filed on Sept. 26, 1975 in the name of Imperial Chemical Industries Limited, describes porous products in the form of sheets, produced from an aggregate of hydrophobic inert organic polymer fibres, and suitable for various applications, such as diaphragms for electrolysis cells, separators for accumulators, fuel cell elements, dialysis membranes and filters. These porous products can optionally contain a wettable additive, of which examples mentioned are inorganic oxides and hydroxides such as, in particular, zirconium oxide, titanium oxide, chromium oxide and magnesium and calcium oxides and hydroxides. As a general rule, it is suggested that titanium oxide or zirconium oxide should be used in all the examples of the application of the porous sheets as diaphragms in cells for the electrolysis of sodium chloride solutions.

It has now been observed that it is possible greatly to improve the performance of cells for the electrolysis of aqueous sodium chloride solutions, the cells being equipped with diaphragms made from a hydrophobic organic polymeric material, by making a quite specific selection amongst the numerous hydrophilic additives which can be used in such diaphragms.

Accordingly, the object of the invention is to provide a diaphragm made from a hydrophobic organic polymeric material, which possesses good mechanical cohesion, is of moderate cost and provides, all other things being equal, improved performance of the cells for the electrolysis of aqueous solutions of an alkali metal halide.

The invention accordingly relates to a permeable diaphragm, made from a hydrophobic organic polymeric material, for a cell for the electrolysis of aqueous solutions of an alkali metal halide, which diaphragm contains a hydrophilic metallic oxide in particle form; according to the invention, the hydrophilic metallic oxide is chosen from amongst the oxides of the metals of group IIa of the periodic table of the elements, the oxide being in the form of particles having a mean diameter at most equal to 0.5 μm.

In the diaphragm according to the invention, the choice of the organic polymeric material is dictated by the need to obtain a diaphragm which withstands the chemical and thermal conditions which normally prevail in electrolysis cells. For example, it is possible to use thermoplastic polymers chosen from amongst the polyolefines, the polycarbonates, the polyesters, the polyamides, the polyimides, the polyphenylenes, the polyphenylene oxides, the polyphenylene sulphides, the polysulphones and mixtures of these polymers. In general, the use of fluorinated polymers is preferred, according to the invention. Advantageously, polymers containing fluorinated monomer units derived from ethylene or from propylene are chosen, preferably polymers containing at least 50%, and more especially at least 75%, of such monomer units. Particularly suitable polymers are those which only contain monomer units derived from ethylene or from propylene, in which all the hydrogen atoms have been replaced by chlorine or fluorine atoms.

By way of example, polymers which are suitable in cases where the diaphragm according to the invention is intended for the electrolysis of sodium chloride brines are those chosen from amongst polytetrafluoroethylene, polychlorotrifluoroethylene, polyvinylidene fluoride, copolymers of ethylene and chlorotrifluoroethylene, copolymers of ethylene and tetrafluoroethylene, copolymers of chlorotrifluoroethylene and vinylidene fluoride, copolymers of hydropentafluoropropylene and vinylidene fluoride, copolymers of hexafluoroisobutylene and vinylidene fluoride, copolymers of tetrafluoroethylene and sulphonylated perfluorovinyl ether and copolymers of tetrafluoroethylene and perfluoroalkyl vinyl ether. Particularly preferred copolymers are those of tetrafluoroethylene and perfluoropropylene.

A first characteristic of the invention is that the hydrophilic additive in the diaphragm is an oxide of a metal chosen from amongst those of group IIa of the periodic table of the elements.

Magnesium oxide has proved particularly advantageous. All other things being equal, the performance of the cells for the electrolysis of aqueous solutions of sodium chloride, equipped with a diaphragm according to the invention, is in fact optimal when the hydrophilic metallic oxide is magnesium oxide.

In the diaphragm according to the invention, the hydrophilic metal oxide is dispersed, in particle form, in the organic polymeric material. These particles can be the amorphous state, in the monocrystalline stage or in the polycrystalline state, and can be in the shape of grains or of fibres.

According to a second characteristic of the invention, the hydrophilic metal oxide particles have a mean diameter not exceeding 0.5 μm, the mean diameter of a particle being defined as the diameter of a sphere having a volume equal to that of the particle.

In practice, for reasons of cost and of ease of operation, it is not desirable to reduce the mean diameter of the particles of the hydrophilic metal oxide to below 0.001 μm.

All other things being equal, good results are generally obtained with hydrophilic metal oxide particles whose mean diameter is between 0.002 μm and 0.2 μm, values below 0.1 μm being preferred. In general, metal oxide particles having a mean diameter of between 0.005 and 0.05 μm have proved particularly advantageous.

The amount of hydrophilic metal oxide in the diaphragm according to the invention is in general chosen so as to be adequate to impart to the diaphragm an adequate degree of wettability by the aqueous electrolytes, without however exceeding a limiting value beyond which the cohesion or mechanical strength of the diaphragm becomes insufficient for its intended function.

The choice of the optimum amount of hydrophilic metal oxide to employ depends on a large number of parameters, which in particular include the nature of the organic polymeric material, the choice of the metal or metals of group IIa present in the composition of the metal oxide, the shape and mean diameter of the metal oxide particles, as well as the intended use of the diaphragm and the desired performance characteristics of the electrolysis cell for which the diaphragm is intended. In general, the optimum amount of hydrophilic metal oxide to employ can be determined in each particular case by routine laboratory work.

In practice, diaphragms according to the invention which have proved suitable for the majority of cases are those which contain a weight of hydrophilic metal oxide which is at least equal to 5% of the total weight of the diaphragm and is in general between 10 and 80% of this total weight. However contents of between 20 and 60% by weight are preferred.

In the diaphragm according to the invention, the hydrophilic metal oxide particles can be present in individual distribution in the mass of organic polymeric material; alternatively, they can be present in situ in the polymeric material and constitute a filler for this material. As a further alternative, a proportion of the hydrophilic metal oxide particles in the diaphragm can be individually distributed in the polymeric material, with the remaining proportion of the particles being embedded in situ in the polymeric material and constituting a filler for this material.

The diaphragm according to the invention can be obtained by any technique commonly used for the manufacture of diaphragms made of an organic polymeric material.

In particular, the diaphragm can be in the form of a thin calendered sheet obtained, for example, by a technique similar to those described in U.S. Pat. Nos. 3,702,267 and 3,627,859, to which reference has been made above.

However, in a preferred embodiment of the diaphragm according to the invention, the organic polymeric material is in a fibrous form.

In this preferred embodiment of the invention, the organic polymeric material can, without distinction, be in the form of fibres or of fibrids; alternatively, it can comprise a mixture of fibres and of fibrids.

The term fibrid denotes a specific structure of the polymeric material. The fibrids consist of an aggregate of a multitude of very thin filaments, having a pellicular appearance and connected to one another so as to form a three-dimensional network. The fibrillar aggregates have a flock-like appearance and an elongate shape; their length varies approximately from 0.5 to 50 mm and their diameter from a few microns to about 5 mm. They are characterised by a high specific surface area, greater than 1 $m^2/g$ and in many cases even greater than 10 $m^2/g$.

The fibrids used within the scope of the invention can, for example, be manufactured by subjecting a mixture of a molten polymer and a solvent to abrupt pressure release by passing it through an appropriate orifice, as described in particular in French Pat. No. 1,596,107 of Dec. 13, 1968 and Nos. 2,148,449 and 2,148,450 of Aug. 1, 1972, and Belgian Pat. No. 811,778 of Mar. 1, 1974 and No. 824,844 of Jan. 17, 1975, all in the name of SOLVAY & Cie.

Alternatively, the fibrids used within the scope of the invention can also be manufactured by other processes, for example one or other of the processes described in French Pat. No. 1,214,157 of June 10, 1958 and No. 1,472,989 of Sept. 24, 1965, in the name of E. I. du Pont de Nemours and Co. In these processes of manufacture, however, continuous fibrillar rovings are obtained, which must subsequently be broken up, for example by grinding.

In cases where the organic polymeric material is in the form of fibres, it is preferable, according to the invention, to use fibres whose diameter is substantially between 0.1 and 25 microns; very suitable fibres are those having a diameter of between 1 and 15 microns.

According to a particularly advantageous variant of the preferred embodiment of the invention, in which the organic polymeric material is in the fibrous form, the hydrophilic metal oxide is contained in situ in the fibrous polymeric material, and constitutes a filler thereof. It has in fact been found that the diaphragms according to this variant of the invention exhibit optimum cohesion and give particularly advantageous results in electrolysis.

All other things being equal, in cases where the invention is applied to diaphragm cells for the electrolysis of aqueous sodium chloride solutions, the diaphragms which give the most advantageous results in electrolysis are those in which the organic polymeric material is perfluorinated and is in a fibrous form, and in which, according to the invention, the hydrophilic metal oxide is magnesium oxide in the form of particles which have a mean diameter of between 0.005 and 0.05 $\mu m$ and which are present in situ in the polymeric material and constitute a filler thereof.

In the preferred embodiment of the invention in which the polymeric material is in a fibrous form, the diaphragm can advantageously be in the form of a felt. The latter is generally obtained by decanting or filtering a suspension of the fibrous polymeric material and of the metal oxide particles in a suitable liquid which dissolves neither the polymeric material nor the metal oxide.

A suitable method of manufacture of such a felt is described in European Patent application No. 79/200,411.1 filed on July 19, 1979, in the name of SOLVAY & Cie.

According to this method of manufacture, the fibres or the fibrids of the polymeric material and the hydrophilic metal oxide particles are dispersed in an organic liquid and the resulting suspension is beaten and is then decanted or filtered.

According to a preferred method of manufacture of the diaphragm according to the invention, a felt is formed from a suspension of the fibrous polymeric material and the hydrophilic metal oxide particles in water or in an aqueous solution. Very suitable aqueous solutions are, in particular, aqueous sodium chloride solutions and aqueous sodium hydroxide solutions. Alkaline brines containing, per liter, from 150 to 200 g of sodium chloride and from 100 to 150 g of sodium hydroxide have proved particularly advantageous; they are generally obtained by electrolysis of sodium chloride brines in diaphragm-type electrolysis cells. In order to facilitate dispersion of the polymeric material and of the hydrophilic metal oxide in water or in the aqueous solution, it may be desirable to add a surface-active agent to the solution. Fluorinated surface-active agents, such as fluorinated or perfluorinated fatty acids, fluorinated or perfluorinated sulphonic acids and salts of these acids, have proved particularly advantageous.

The surface-active agent can be introduced separately into the aqueous solution.

However, it has proved particularly advantageous to introduce the surface-active agent in situ into the fibrous polymeric material, at the time of its manufacture, so that it constitutes a filler for the polymeric material.

The optimum amount of surface-active agent to employ depends on various factors, which in particular include the nature of the polymer, the dimensions of the polymer fibres or fibrids, the nature of the aqueous solution and the nature of the surface-active agent. The optimum amount can be determined in each particular case by routine laboratory work.

In general, good results are obtained if the surface-active agent is used in an amount of between 0.5 and 10% of the weight of the polymeric material, though values of between 2 and 7% are preferred.

To form the felt from the aqueous suspension of the fibrous polymeric material and of the hydrophilic metal oxide, it suffices to decant or filter the suspension. For example, it is possible to filter the aqueous suspension through a fine-mesh cloth and dry the felt thus formed on the cloth, and then remove it from the cloth and introduce it, in the form obtained, as a diaphragm into an electrolysis cell.

However, according to the invention it is preferred to form the felt by filtering the abovementioned suspension directly through a perforated support for the diaphragm, by applying a technique analogous to that which is commonly used for the manufacture of asbestos diaphragms and is described, in particular, in U.S. Pat. No. 1,865,152 in the name of K. E. Stuart, of June 28, 1932, and U.S. Pat. No. 3,344,053 in the name of Neipert et al., of May 4, 1964. The perforated support for the diaphragm can advantageously be the perforated cathode of the diaphragm-type electrolysis cell. This embodiment has the advantage that it allows the diaphragm to be manufactured in situ on cathodes having a complicated shape with a non-developable surface, for example cathodes of the type of those with which the electrolysis cells described in French Pat. No. 2,223,083 of Mar. 28, 1973 and No. 2,248,335 of Oct. 14, 1974, in the name of SOLVAY & Cie, are equipped.

According to an advantageous variant of this method of manufacture of the diaphragm according to the invention, the dispersion of the polymeric material and of the metal oxide in water or in an aqueous solution, and the filtration of the resulting aqueous suspension through the perforated support, are carried out in one and the same apparatus, which is known per se for the manufacture of asbestos diaphragms and is described in French Pat. No. 2,308,702 of Apr. 25, 1975, in the name of SOLVAY & Cie.

In the particular case where this preferred method of manufacture is used to form the diaphragm felt, in situ, on a profiled cathode grid of parallel fingers, for example of the type of those with which the electrolysis cells described in the abovementioned French Pat. Nos. 2,223,083 and 2,248,335 are equipped, it is desirable to use the technique described in U.S. Pat. No. 3,970,041, filed on Apr. 2, 1975, in the name of Morton S. Kircher, which consists of engaging separators between the successive cathode fingers during the formation of the felt.

The diaphragm according to the invention has the advantage of possessing good mechanical cohesion and of exhibiting dimensional stability during its use in an electrolysis cell. It has the advantageous property of excellent wettability by aqueous electrolytes, especially by sodium chloride brines.

In addition to these advantageous properties, the diaphragm according to the invention has the particularly valuable characteristic of generally possessing a permeability to aqueous electrolytes of the same order of magnitude as that of the asbestos diaphragms with which cells for the electrolysis of sodium chloride brines are normally equipped, so that it is very suitable for replacing the asbestos diaphragms of the existing electrolysis cells, for example of the type of those described in French Pat. No. 2,164,623 of Dec. 12, 1972, No. 2,223,083 of Mar. 28, 1973, No. 2,230,411 of Mar. 27, 1974 and No. 2,248,335 of Oct. 14, 1974, all in the name of SOLVAY & Cie.

The diaphragm according to the invention furthermore has the valuable and surprising property of possessing the requisite optimum characteristics of wettability and permeability from the very start of its use. This property of the diaphragm according to the invention offers the considerable advantage that the electrolysis cells are from here onwards capable of operating under normal running conditions, with optimum energy efficiency, from the very start of being put into operation with a new diaphragm.

The diaphragm according to the invention can optionally contain, in addition to the polymeric material and the hydrophilic metal oxide, other conventional constituents of permeable diaphragms, intended to impart additional properties to the diaphragm.

The value of the invention will emerge from a few use examples given below.

In these examples, a few electrolysis experiments were carried out in a laboratory cell possessing a vertical anode and a vertical cathode, separated by a diaphragm. The anode consisted of a circular titanium plate of size 113 $cm^2$, carrying an active coating consisting of an equimolar mixture of ruthenium dioxide and titanium dioxide. The cathode consisted of a circular grid of mild steel, of size 113 $cm^2$, carrying the diaphragm on the face confronting the anode. The distance between the anode and the cathode was 5 mm.

FIRST SERIES OF EXPERIMENTS (ACCORDING TO THE INVENTION)

Examples 1 to 3 relate to electrolysis experiments with diaphragms according to the invention.

EXAMPLE 1

A diaphragm formed from a mixture of 68% by weight of fibrids of a copolymer of tetrafluoroethylene and perfluoropropylene and 32% by weight of magnesium oxide particles was used in the cell.

The fibrids have a mean specific surface area of about 23 $m^2/g$. They were obtained by subjecting a two-phase mixture of the molten polymer and of a suitable solvent to abrupt expansion through an orifice of small cross-section, as described in French Pat. No. 1,596,107 of Dec. 13, 1968 and Nos. 2,148,449 and 2,148,450 of Aug. 1, 1972, and Belgian Pat. No. 811,778 of Mar. 1, 1974 and No. 824,844 of Jan. 17, 1975, all in the name of SOLVAY & Cie.

The magnesium oxide particles have a mean diameter of between 0.02 and 0.04 $\mu m$.

In order to manufacture the diaphragm, the fibrids and the magnesium oxide particles were dispersed in an alkaline brine containing approximately 8% by weight of sodium hydroxide and 16% by weight of sodium chloride. The alkaline brine furthermore contained 400 mg per liter of the product known by the name of "Polymin P" (BASF), which is a polyethyleneimine-based retention agent.

After the suspension had been homogenised, the cathode of the cell was immersed therein and the suspension was sucked through the latter so as to deposit, on its surface, a felt consisting of a mixture of fibrids and magnesium oxide particles. The felt had a weight corresponding approximately to 1.3 $kg/m^2$ of cathode surface area, and contained approximately 68% by weight of fibrids and 32% by weight of magnesium oxide.

After forming the felt on the cathode, the latter was immediately mounted in the laboratory cell and the electrolysis of a brine containing 255 g of sodium chloride per kg was carried out in the cell, with a constant current density equal to 2 $kA/m^2$ of anode. The temperature in the cell was kept at about 85° C. throughout the duration of the experiment.

The variation with time of the permeability of the diaphragm, of the sodium hydroxide content in the catholyte, of the electrolysis potential at the cell terminals and the current efficiency at the anode have been recorded in Table I below. The diaphragm permeability, expressed in $h^{-1}$, is defined by the following relation:

$$K = \frac{Q}{S \times H}$$

wherein:

Q denotes the flow rate of brine through the diaphragm (in $cm^3/h$);

S denotes the cross-section of the diaphragm (in $cm^2$); and

H denotes the hydrostatic pressure of brine on the diaphragm, expressed in cm of column of brine.

TABLE I

| Duration of electrolysis (days) | Permeability ($h^{-1}$) | Sodium hydroxide in the catholyte (% by weight) | Potential (V) | Current efficiency (%) |
|---|---|---|---|---|
| 6 | 1.45 | 10.1 | 3.15 | 92 |
| 27 | 1.80 | 9.1 | 3.27 | 95.5 |

EXAMPLE 2

In the experiment which follows, the magnesium oxide powder and a surface-active agent were combined with the polymer (a copolymer of tetrafluoroethylene and of perfluoropropylene) in situ in the fibrids, at the time of manufacture of the latter. For this purpose, before manufacturing the fibrids by expanding the two-phase mixture of the polymer and of the solvent, as described in Example 1, the magnesium oxide particles and the surface-active agent were incorporated into the said mixture. The respective amounts of magnesium oxide and of surface-active agent which were employed were regulated so that the resulting fibrids contained about 58% by weight of polymer, 39% by weight of magnesium oxide and 3% by weight of fluorinated surface-active agent. The magnesium oxide particles employed had a mean diameter of between 0.02 and 0.04 μm.

The fibrids thus obtained had a specific surface area of about 25 $m^2/g$.

A diaphragm consisting exclusively of such fibrids was deposited on the cathode of the laboratory cell, by applying the method described in Example 1, but without incorporating the "Polymin P" retention agent into the alkaline brine bath. The weight of diaphragm obtained corresponded to about 1.3 $kg/m^2$ of cathode.

The electrolysis conditions employed in the experiment of Example 1 were then reproduced. The results obtained are shown in Table II.

TABLE II

| Duration of electrolysis (days) | Permeability ($h^{-1}$) | Sodium hydroxide in the catholyte (% by weight) | Potential (V) | Current efficiency (%) |
|---|---|---|---|---|
| 8 | 0.18 | 13.1 | 3.20 | 89.3 |
| 13 | 0.15 | 10.9 | 3.23 | 94.9 |
| 120 | 0.17 | 9.6 | 3.30 | 98.2 |

EXAMPLE 3

The diaphragm used in this experiment consisted of a felt formed from a mixture of individual particles of magnesium oxide, identical to those used in Example 1, and of fibrids filled with magnesium oxide and with a fluorinated surface-active agent, the fibrids being identical to those used in the experiment of Example 2. The amounts employed were regulated so that the diaphragm formed on the cathode had a weight equivalent to 1.4 $kg/m^2$ of cathode surface area and contained about 93% of fibrids filled with magnesium oxide and with surface-active agent and 7% of individual particles of magnesium oxide.

The electrolysis experiment, for which the conditions of Examples 1 and 2 were reproduced, gave the results shown in Table III.

TABLE III

| Duration of electrolysis (days) | Permeability ($h^{-1}$) | Sodium hydroxide in the catholyte (% by weight) | Potential (V) | Current efficiency (%) |
|---|---|---|---|---|
| 1 | 0.12 | 7.6 | 3.03 | 98.7 |
| 14 | 0.14 | 10.2 | 3.04 | 94.5 |
| 22 | 0.14 | — | 3.10 | — |

COMPARATIVE EXPERIMENT

Example 4 relates to an electrolysis experiment with a prior-art diaphragm.

EXAMPLE 4

Prior to the electrolysis experiment which will be described below, fibrids were manufactured from a copolymer of tetrafluoroethylene and of perfluoropropylene, filled with a titanium dioxide powder and a fluorinated surface-active agent. The fibrids were manufactured by a technique similar to that employed for obtaining the fibrids of Example 2. The titanium dioxide particles employed in the manufacture of the fibrids had a mean diameter of about 0.02 μm. The respective amounts of polymer, of titanium dioxide and of surface-active agent employed were regulated so that the resulting fibrids contained approximately 48.75% by weight of polymer, 48.75% by weight of titanium dioxide and 2.50% by weight fluorinated surface-active agent.

A diaphragm consisting exclusively of such fibrids was desposited on the cathode of the laboratory cell, by applying the method described in Example 2. The weight of the diaphragm obtained corresponded to about 1.3 $kg/m^2$ of the cathode.

The same electrolysis conditions as in the experiments of Examples 1 and 3 were employed. The results obtained are shown in Table IV.

TABLE IV

| Duration of electrolysis (days) | Permeability ($h^{-1}$) | Sodium hydroxide in the catholyte (% by weight) | Potential (V) | Current efficiency (%) |
|---|---|---|---|---|
| 4 | >3 | 9.3 | 3.75 | 85 |
| 7 | >3 | 9.7 | 3.75 | 87.5 |
| 14 | >3 | 9.7 | 3.75 | 87.4 |

A comparison of the results of the experiments of Examples 1 to 3 with those of the comparative experiment of Example 4 immediately shows that the diaphragms according to the invention have better permeability, allow the use of lower electrolysis potentials, and give higher current efficiencies.

We claim:

1. A process of manufacturing chlorine and hydrogen gases which comprises placing in an electrolytic cell having an anode and cathode an aqueous solution of alkali metal chloride, positioning betweeen said anode and cathode a permeable diaphragm comprising a porous sheet of hydrophobic fluorinated organic polymeric material containing magnesium oxide in an amount equal to between 20% and 60% of the total weight of the sheet, said magnesium oxide being in the form of particles having a mean diameter at most equal to 0.5 microns freely dispersed throughout the polymeric material of the sheet and passing electric current through said solution and diaphragm between said cathode and anode to produce hydrogen at the cathode and chlorine at the anode.

2. A process according to claim 1, in which said hydrophobic polymeric material with said magnesium oxide particles dispersed therein is integrated with a perforate support by being deposited thereon from an aqueous suspension of said hydrophobic polymeric material in fibrous form and said magnesium oxide particles.

3. A process according to claim 2, in which said hydrophobic material is in the form of fibrids.

4. A process according to claim 1, in which the particles of magnesium oxide have a mean diameter of between 0.002 and 0.2 microns.

5. A process according to claim 1, in which said permeable diaphragm further comprises a surface active agent in the amount of between 2% and 7% of the weight of said hydrophobic polymeric material as a filler.

6. A process according to claim 1, in which said hydrophobic polymeric material is a copolymer of tetrafluoroethylene and perfluoropropylene.

7. In a process of manufacturing chlorine and hydrogen gases, the sequence of steps of forming a permeable diaphragm in situ on a perforate support from an aqueous suspension of hydrophobic fluronated organic polyeric material and magnesium oxide in the form of particles having a mean diameter at most equal to 0.5 microns dispersed throughout said polymeric material, said magnesium oxide constituting between 20% and 60% of the total weight of said diaphragm, drying said diaphragm, positioning said diaphragm between the anode and cathode of an electrolytic cell containing an aqueous solution of alkali metal chloride and passing electric current through said solution and diaphragm between the anode and the cathode to produce hydrogen at the cathode and chlorine at the anode.

* * * * *